United States Patent [19]

Orthuber

[11] 4,041,343

[45] Aug. 9, 1977

[54] ELECTRON MULTIPLIER MOSAIC

[75] Inventor: Richard K. Orthuber, Sepulveda, Canada

[73] Assignee: International Telephone and Telegraph Corporation, Nutley, N.J.

[21] Appl. No.: 294,764

[22] Filed: July 12, 1963

[51] Int. Cl.[2] ..... H01J 43/00

[52] U.S. Cl. ..... 313/105 R; 250/213 R; 315/12 R

[58] Field of Search ..... 313/66, 67, 96, 94, 313/95, 103 CM, 104, 105 R, 105 CM; 250/213, 213 R, 213 VT; 315/12 R

[56] References Cited

U.S. PATENT DOCUMENTS

| | | | |
|---|---|---|---|
| 2,929,934 | 3/1960 | Nicoll | 250/213 |
| 2,931,914 | 4/1960 | Orthuber et al. | 250/213 |
| 3,062,962 | 11/1962 | McGell | 250/213 |

*Primary Examiner*—Maynard R. Wilbur
*Assistant Examiner*—T. M. Blum
*Attorney, Agent, or Firm*—John T. O'Halloran

EXEMPLARY CLAIM

1. An electron multiplier mosaic structure comprising:
   a plurality of alternate layers of uniform metallic and insulating material;
   an intermediate coating of metallic bonding material joining each adjacent layer in a solid unitary structure;
   a plurality of closely spaced apertures formed through said layers and arranged in a regular pattern on the opposite ends of said structure, each said aperture forming a continuous smooth interior surface between said ends, the metallic layer portions of said surface having secondary emission characteristics.

13 Claims, 4 Drawing Figures

INVENTOR.
RICHARD K. ORTHUBER
BY Edward Goldberg
ATTORNEY

INVENTOR.
RICHARD K. ORTHUBER
BY Edward Goldberg
ATTORNEY

ELECTRON MULTIPLIER MOSAIC

This invention relates to electron image intensifiers and particularly to a novel mosaic multiplier construction which facilitates assembly of successive dynodes in highly precise registration and improves the collection of photoelectrons from an emissive surface.

Previous electron multipliers of the mosaic type have utilized a plurality of closely spaced parallel multiplier channels, each accepting the primary photo-current emitted by a small element of a photocathode opposing the input side and intensifying these currents independently in each channel by impact on secondary emissive coatings on succeeding dynodes. These discrete dynode multipliers have had difficulties in achieving high resolutions due to problems in alignment between the large numbers of minute channels in adjacent layers which are stacked to form the parallel paths. Precise registration of the various channels and layers has not been satisfactorily obtained primarily for the reason that the identical layers are subject to minute distortions during assembly operations and subsequent heating and mounting of the assembly in a tube.

A proposed solution to this problem has utilized continuous tubular glass channels in a common slab, wherein multiplication occurs by electrons striking the secondary emissive surface at various successive locations along each channel. However, emission parameters in this form vary in uncontrollable fashion, so that impact energy may assume a wide range of values within the limits of the operating voltages. Resulting variations in secondary emission yields cause undesirable noise and non-uniform displacement between impact points makes the number of multiplication steps uncertain. In contradistinction, the more conventional discrete dynode form, although having poor alignment, has virtually identical impact energy characteristics and closely controllable voltages at the various multiplier layers. A further problem occuring in the prior art devices was that electrons from the cathode were not efficiently collected by the limited preferred areas of the facing dynodes. Attempts to improve this condition included shaping the cathode surface, applying the photoemissive material to the face of the dynode and utilizing an intermediate field-shaping grid. These methods, however, added to the difficulties involved in achieving proper registration.

It is therefore the primary object of the present invention to provide a novel mosaic multiplier device and construction which combines the favorable noise characteristics and freedom from dynode registration problems of the prior art forms. A further object is to improve the efficiency of collection of photoelectrons from the cathode in the dynode channels.

These results are achieved by a novel arrangement of layers of alternate metallic and insulating sheets with thin conductive films on the metal layers which bond the elements together when heated to form a unitary sandwich structure. Smooth holes are provided after the bonding by a suitable drilling process, which inherently eliminates registration problems between laminations. A voltage divider provides successively increasing potentials between the input photocathode, the various dynode layers and a phosphor screen target electrode on the output side, which achieves uniform multiplication with minimum noise. Efficient collection of photoelectrons by the dynode channels is provided by a unique configuration which shapes the electric field between the cathode and first dynode layer. Annular depressions or an additional potential on the surface layer shape the field and focus the divergent electrons on the desired portions of the dynode channels. The parallel channels may also be positioned at an angle to further improve the collection of electrons.

The details of the invention will be more fully understood and other objects and advantages will become apparent in the following description and accompanying drawings, wherein.

Figure 1:
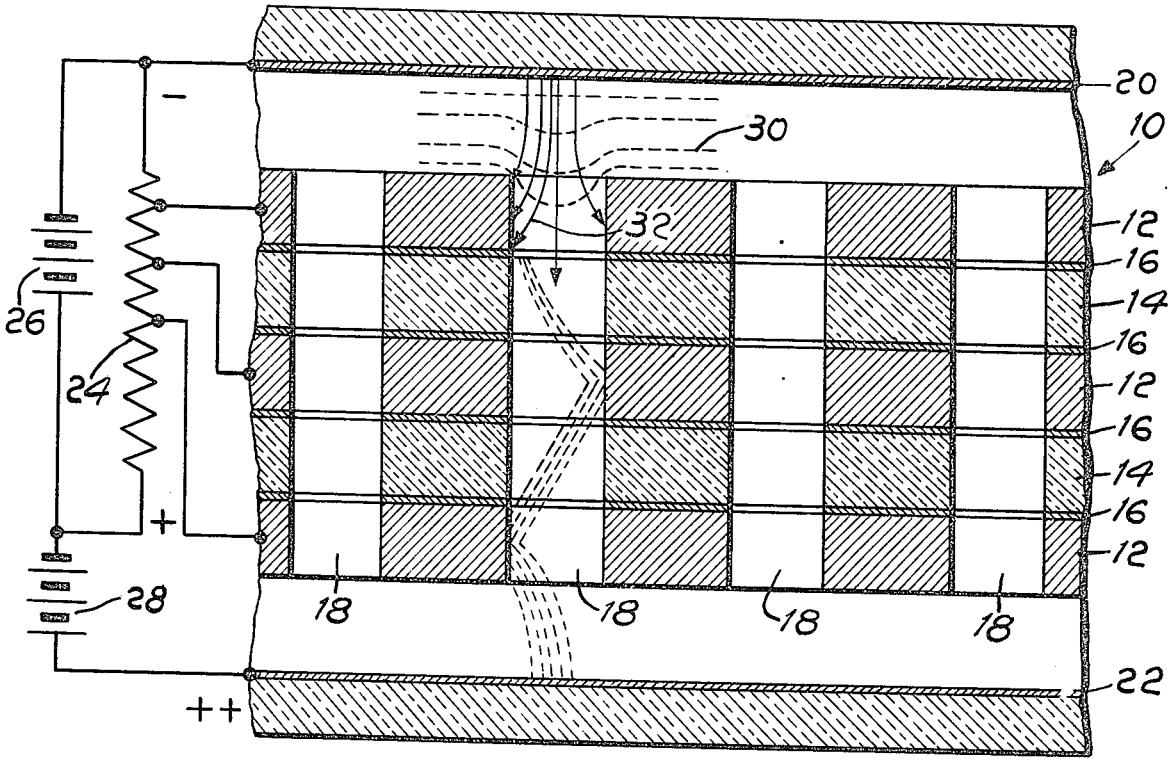
FIG. 1 shows the novel mosaic multiplier layered structure.

As shown in FIG. 1, the mosaic sandwich 10 is formed of alternate layers of metallic sheets 12 and insulating sheets 14, which are bonded together by a thin film 16 of a suitable metal, preferably indium. The films or coatings are electro-plated onto metal sheets 12 and the assembly heated to form a solid unitary structure. The metallic sheets are formed of silver magnesium alloy or other conductive material, such as copper beryllium, which characteristically can produce high secondary emission yields. The insulating layers are preferably formed of a suitable high conductivity glass to provide proper field distribution with minimum charge accumulation on the channel walls, so that high output brightness may be achieved. Aluminum oxide, periclase, mylar or other dielectric materials may similarly be employed.

The bonded laminations are then provided with cylindrical holes 18 by a suitable drilling or boring process. Particularly advantageous is the use of fine high power electron or laser beams. In this manner, smooth cylindrical holes with a small diameter to length ratio and diameters of a few microns may be obtained. The process may readily be automated to produce large numbers of holes in any desired regular pattern. Pulsing of the beam avoids undesired heat dissipation and confines the area of vaporized material. Since the holes are provided after the laminations are securely bonded, the difficulty of registering the channels of adjacent dynodes is inherently eliminated. The thickness of the metallic dynode and insulator layers and hole diameter to sheet thickness ratio are shown having similar orders of magnitude. The most favorable dimensions, however, must be selected empirically by means of models or by field plotting and electron trajectory tracing, according to wellknown methods. The basic criteria is that a maximum number of secondary electrons emitted at the lower half of a dynode hole be transferred to the lower half of the next adjacent dynode hole.

For use as an electron image intensifier, the dynode sandwich may be mounted in an evacuated envelope with the input side facing a photoemissive surface 20 and the output side facing a target electrode or phosphor screen 22. Successively increasing potentials are applied to the photocathode and the dynode layers by a voltage divider 24 and direct voltage source 26, while a higher voltage supply 28 establishes an accelerating field between the output dynode face and phosphor screen.

In order to improve the intensified output image, it is necessary to collect the photoelectrons emitted from the cathode into the dynode channels, in an efficient manner. Otherwise, poor signal to noise ratios and high secondary emission noise losses are encountered. The electric field distribution at the entrance apertures of the channels of the device of FIG. 1 is indicated by dotted lines 30 between the cathode and first dynode surface. Electrons emitted from the photocathode surface opposing the channel aperture are normally accelerated toward the dynode structure and away from the channel axis, as shown by arrows 32 representing electron trajectories. This gradient is beneficial in minimizing the number of electrons which, being emitted close to the axis, would bypass the first layer and penetrate deeply into the channel. However, the same effect prevents electrons emitted further away from the axis from striking the effective area at the lower half of the first dynode. The useful area is limited since secondaries emitted at the upper half tend to intercept the same dynode and are lost for further multiplication. As a result only a small portion of the photoelectrons emitted by the cathode surface located above the channel can impact in the effective lower dynode area.

Figure 2:
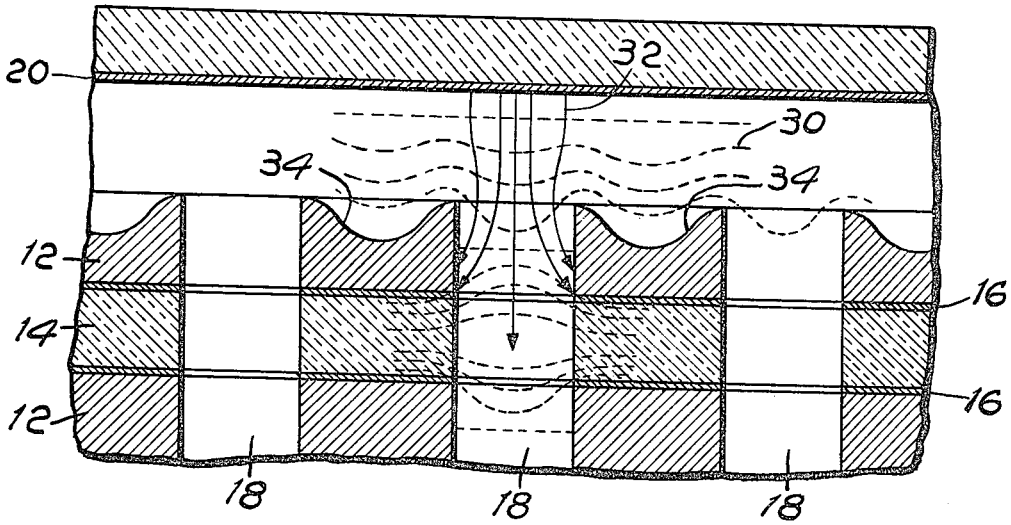
FIG. 2 shows an arrangement of the multiplier having a shaped field.
Figure 3:
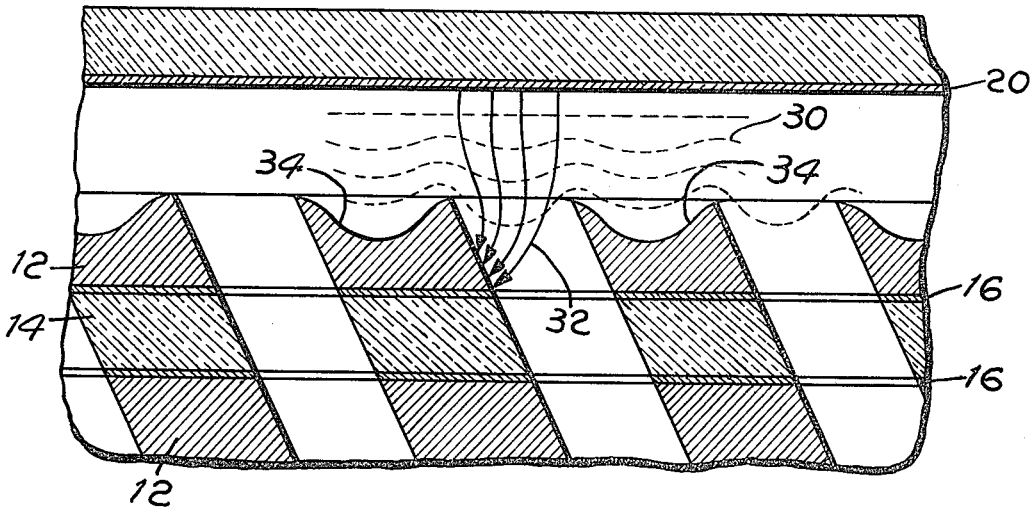
FIG. 3 shows an improved form of the device having inclined channels.

As shown in FIG. 2, annular depressions 34 are provided at the metallic input face surrounding each aperture, which deform the electrostatic field so that the off-axis gradients and electron divergence are reduced. The trajectories 32 are thus curved inwardly toward the desired channel area and a larger active cathode surface is effectively utilized. Some additional loss of paraxial electrons occurs, but this is minor in comparison with the increased gain from the extended cathode area. Furthermore, such losses can be eliminated by boring the channels at an oblique angle to the plane of the laminated structure, as shown in FIG. 3. The annular depressions have the advantage of being integrated with the mosaic structure and cause no registration difficulties. In addition, they may be produced by the same electron beam utilized for forming the channels. A preferred method is to deflect the beam by two pairs of electrostatic deflection plates, arranged in a well-known manner and energized by two voltages out of phase by 90°, to describe a circular path on the upper face of the first dynode metallic layer. Varying the amplitude of the voltages and the intensity or duty cycle of the beam will produce any desired cross-section, with the optimum dimensions being determined by suitable methods, as previously mentioned.

Figure 4:
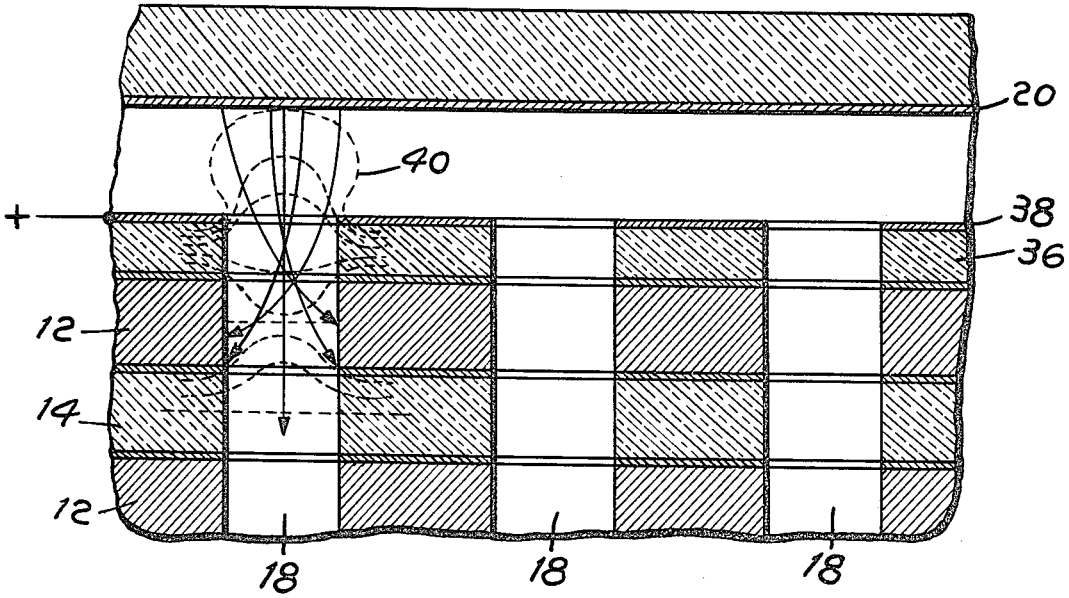
FIG. 4 shows another variation of the shaped field multiplier.

Another form of field shaping is illustrated in FIG. 4, wherein an additional apertured insulating layer 36 and a thin conductive metallic coating 38 are bonded to the surface of the first dynode 12, with a potential applied to the coating which is only a small fraction of that of the first dynode. The weak field between coating 38 and cathode 20 tends to cause a virtually field-free space in front of the emissive surface, while the strong field between the first dynode 12 and coating 38 penetrates into the space to produce the pattern 40 as illustrated. This field distribution thus focuses the photoelectrons in the desired manner onto the active lower region of the first dynode. Again the registration problem is avoided by electron beam forming of the apertures after the entire structure is bonded. As in the previous configuration, the interception of paraxial electrons may also be improved by use of inclined channels.

It may thus be seen that the present invention provides a novel multiplier mosaic structure which achieves improved resolution by eliminating the problem of precise dynode alignment and increases the efficiency of electron collection and uniformity of operation. While several embodiments have been illustrated, it is apparent that the invention is not limited to the exact forms or uses shown and that many other variations may be made in the particular design and configuration without departing from the scope of the invention as set forth in the appended claims.

What is claimed is:

1. An electron multiplier mosaic structure comprising:

a plurality of alternate layers of uniform metallic and insulating material;

an intermediate coating of metallic bonding material joining each adjacent layer in a solid unitary structure;

a plurality of closely spaced apertures formed through said layers and arranged in a regular pattern on the opposite ends of said structure, each said aperture forming a continuous smooth interior surface between said ends, the metallic layer portions of said surface having secondary emission characteristics.

2. The device of claim 1 including an electron emissive photosensitive surface spaced from and opposing one end of said structure;

a phosphor screen spaced from and opposing the other end of said structure;

means directing electrons across said insulator layers onto said metallic layers within said apertures, including voltage supply means establishing increasing electron accelerating potentials between said emissive surface, said plurality of metallic layer portions and said phosphor screen, said metallic layers forming successive multiplier dynodes.

3. A device of claim 2 wherein said apertures form a plurality of identical parallel multiplier channels through said dynodes.

4. The device of claim 3 including electrostatic field-shaping means on said one end for directing electrons from said emissive surface onto predetermined interior surfaces of the first dynode layer.

5. The device of claim 4 wherein said field-shaping means comprises annular depressions surrounding each aperture on the outer metallic surface of said first dynode layer facing said photosensitive surface.

6. The device of claim 4 wherein said field-shaping means comprises a further correspondingly apertured insulating layer and a relatively thin outer metallic conductive coating on said insulating layer facing said photosensitive surface, said insulating layer being bonded to said first dynode layer, and means applying a potential to said outer coating which is a small fraction of that applied to said first dynode.

7. The device of claim 4 wherein said apertures are positioned at an oblique angle with respect to the plane of said layers.

8. A method of forming an electron multiplier mosaic structure from a plurality of metallic and insulating layers, the metallic layers having high secondary emission characteristics comprising the steps of:

applying a coating of metallic bonding material to each metallic layer;

assembling said metallic and insulating layers in an alternating arrangement with said coating therebetween;

heating said assembly to bond said layers in a solid unitary structure; and boring a plurality of regularly spaced identical parallel apertures through said bonded unitary structure to form continuous smooth surfaces within each aperture through all said layers.

9. The method of claim 8 wherein said boring is performed by an electron beam.

10. The method of claim 8 including forming annular depressions on an outer metallic layer around each said apertures.

11. The method of claim 8 including assembling a further insulating layer and a relatively thin outer metallic conductive coating on one end of said structure before heating.

12. The method of claim 8 wherein said apertures are formed at an oblique angle with respect to the plane of said layers.

13. The method of claim 8 wherein said boring is performed by a laser beam.

* * * * *